US007798329B2

(12) United States Patent
Gelardi

(10) Patent No.: US 7,798,329 B2
(45) Date of Patent: Sep. 21, 2010

(54) INSERT PACKAGE

(75) Inventor: John A. Gelardi, Wake Forest, NC (US)

(73) Assignee: MeadWestvaco Corporation, Richmond, VA (US)

( * ) Notice: Subject to any disclaimer, the term of this patent is extended or adjusted under 35 U.S.C. 154(b) by 178 days.

(21) Appl. No.: 11/969,146

(22) Filed: Jan. 3, 2008

(65) Prior Publication Data

US 2008/0257773 A1 Oct. 23, 2008

Related U.S. Application Data

(60) Provisional application No. 60/912,849, filed on Apr. 19, 2007.

(51) Int. Cl.
*B65D 83/04* (2006.01)

(52) U.S. Cl. ..... 206/531; 206/1.5; 206/528; 206/538; 206/536

(58) Field of Classification Search ..... 206/1.5, 206/722–4, 467, 468, 523, 531, 532, 536, 206/538, 539, 583, 594, 807, 828, 528, 485; 229/122, 125.125; 220/295, 300, 347, 4.21, 220/4.01, 4.28, 529
See application file for complete search history.

(56) References Cited

U.S. PATENT DOCUMENTS 1,051,070 A * 1/1913 Boye ..... 220/259.5
1,994,063 A * 3/1935 Bruns et al. ..... 206/528
2,101,687 A * 12/1937 Paul ..... 206/536
3,049,224 A * 8/1962 Fredette et al. ..... 206/532
3,387,699 A 6/1968 Heller
3,441,165 A * 4/1969 Zampichelli ..... 220/787
3,782,584 A * 1/1974 Swenson et al. ..... 220/345.3

(Continued)

FOREIGN PATENT DOCUMENTS

DE 40 01 645 A1 8/1991

(Continued)

OTHER PUBLICATIONS

U.S. Appl. No. 11/969,100, filed Oct. 16, 2008, Gelardi, John A.

(Continued)

*Primary Examiner*—Mickey Yu
*Assistant Examiner*—Chun Cheung
(74) *Attorney, Agent, or Firm*—MWV Intellectual Property Group

(57) ABSTRACT

An insert package includes an insert and a container. The container is formed by assembling an upper housing member and a lower housing member, thereby creating a void bound by side walls and a closed end. The container includes rails or channels, and an open end with an engageable cover. When the cover is open, the open end provides access to the void. An insert can be passed into container through the open end. The insert is a package for storing and dispensing items, such as a blister card. The insert includes wings and the wings can include lugs or detents. The wings are designed to interface with the rails, to align the insert with the container during storage and dispensing of the items. A retainer in the container, and a retainer receiver on the insert (or vice versa) can selectively immobilize the insert. A release can disengage the insert and allow slideable movement of the insert into and out of the container.

21 Claims, 4 Drawing Sheets

U.S. PATENT DOCUMENTS

| | | | | | |
|---|---|---|---|---|---|
| 3,888,350 | A | * | 6/1975 | Horvath | 206/531 |
| 3,942,630 | A | * | 3/1976 | Phillips | 206/1.5 |
| 4,120,400 | A | | 10/1978 | Kotyuk | |
| 4,126,224 | A | * | 11/1978 | Laauwe et al. | 206/540 |
| 4,192,422 | A | | 3/1980 | Kotyuk | |
| 4,561,544 | A | * | 12/1985 | Reeve | 206/540 |
| 4,593,813 | A | * | 6/1986 | Powel | 206/708 |
| 5,019,125 | A | | 5/1991 | Rebne et al. | |
| 5,038,932 | A | * | 8/1991 | Sheu | 206/387.1 |
| 5,125,505 | A | * | 6/1992 | Kurosaki | 206/39.4 |
| 5,275,291 | A | * | 1/1994 | Sledge | 206/531 |
| 6,338,408 | B1 | | 1/2002 | Anderson | |
| 6,349,831 | B1 | | 2/2002 | Buss | |
| 6,640,693 | B2 | | 11/2003 | Brezovnik et al. | |
| 2003/0062287 | A1 | | 4/2003 | Gelardi et al. | |
| 2003/0102321 | A1 | | 6/2003 | Maietta | |
| 2003/0209460 | A1 | | 11/2003 | Bolnick et al. | |
| 2004/0256277 | A1 | * | 12/2004 | Gedanke | 206/538 |
| 2005/0183981 | A1 | | 8/2005 | Gelardi | |

FOREIGN PATENT DOCUMENTS

| | | | |
|---|---|---|---|
| EP | 0547730 | A2 | 6/1993 |
| EP | 1 002 744 | A1 | 5/2000 |
| EP | 1277670 | B1 | 5/2005 |
| GB | 1279941 | A | 6/1972 |
| JP | 2000 062843 | | 2/2000 |
| WO | WO 2004/037657 | | 5/2004 |
| WO | WO 2005/030606 | | 4/2005 |
| WO | WO 2005/068304 | A2 | 7/2005 |
| WO | WO 2007/101098 | | 9/2007 |

OTHER PUBLICATIONS

U.S. Appl. No. 11/994,811, filed Jan. 4, 2008, Thanhhung Le.
U.S. Appl. No. 11/969,616, filed Jan. 4, 2008, Ricky N. Williams.
U.S. Appl. No. 11/969,100, filed Jan. 3, 2008, John A. Gelardi.

* cited by examiner

INSERT PACKAGE

RELATED APPLICATION

This application claims priority to U.S. Provisional Patent Application No. 60/912,849, filed Apr. 19, 2007, the entirety of which is hereby incorporated by reference.

TECHNICAL FIELD

This disclosure relates generally to packaging. More specifically, the disclosure relates to a package having a card-type insert that can be at least partially withdrawn from a lockable enclosure.

BACKGROUND

Child-resistant or lockable containers, wherein multiple or complex movements are required to open the container, have many uses. One use for a child-resistant or lockable container is to control the dispensing of items. Child resistant or lockable containers are often used to store and/or dispense pharmaceutical products, including medicine and medicaments in the form of pills and tablets. One well known example of such child-resistant or lockable containers is the inclusion of a locking cap on a medicine bottle. Locking caps typically require coordinated and complex movements. For example, some locking cap mechanisms require a coordinated alignment and tipping, axial pressure, or inward radial squeezing while turning the cap, to enable a consumer to remove the locking cap it from its container in order to access the medicaments.

Some products, such as medicines, are packaged in convenient flat boxes, which are often more difficult to secure with child-resistant features. One such method of packaging is the well known blister pack. Many medicaments in the form of tablets or caplets are sold in blister packs—blisters formed on a sheet sealed by a barrier that is punctured when extracting a tablet from a blister. When a typical cardboard flat box holding one or more blister packs is opened the entire contents of the package is exposed, making all of the tablets immediately available. The dangers posed by children with access to a large quantity of tablets not intended for their consumption is self evident.

One method commonly used to address this danger is to increase the gauge of the materials used to form the package, thereby increasing the force required to remove an item from a blister. One problem with this approach is that pharmaceuticals are often fragile, and the increased force can cause breakage of the product. Another problem is that many users of pharmaceuticals are elderly and many have diminished physical ability and dexterity, particularly in the hands. The increased force required may be too great for such consumers to exert to access the products.

Another method for creating child resistance features on a blister pack is the inclusion of complex movements that are not intuitive. Directions included with such packages instruct a consumer how to properly manipulate the package so as to gain access to the items contained therein.

SUMMARY

An insert package includes an insert and a container. The container is formed by assembling an upper housing member and a lower housing member. The assembled container includes a void, which is bound by side walls and a closed end. The container also includes an open end with an engageable cover, for example, a door or a deflectable tab. When the door is open, the open end provides access to the void. An insert can be passed into container through the open end. When the door is closed, the opening is blocked off to prevent access to the container, or to prevent removal of the insert from within the container.

The container includes internal rails that are defined by internal walls and optionally external walls of the container. These rails, or channels, are included to guide an insert while being translated from a storage position to a dispensing position, and vice versa. The container can also include one or more springs, posts, hooks, latches, lips, magnetic or metallic members, adhesives, detents, VELCRO® fasteners, combinations thereof, or any other suitable engagement mechanisms, extending from one or more of the housing members.

An insert includes a package for storing and dispensing items. Exemplary packages include, but are not limited to, a card, a blister pack, a tray, or a compartmentalized drawer for holding items. The insert includes wings and the wings can optionally include lugs or detents. The wings are designed to interface with the rails, or channels, to align the insert with the container during storage and dispensing of the items. The lugs can include material projecting from the wings and can be shaped according to desired characteristics or needs. For example, the lugs can be wedge-shaped or hemispherical to allow the lugs to slide along the rails with fairly little friction. The lugs can engage the rails, the side walls, locking apertures along the rails or side walls, a retaining surface near the container opening, combinations thereof, or the like.

The insert can also include one or more apertures, hooks, lips, latches, magnetic or metallic members, adhesives, VELCRO® fasteners, combinations thereof, or any other suitable receiving mechanisms. The receiving mechanism can interface with the engagement mechanism to lock the insert in a storage position within the container. For example, if the engagement mechanism is a post, then the receiving mechanism can be, for example, an aperture that engages the post.

The container can also include a release mechanism, for example, a release button. The release button can be used to disengage the insert from the container by disengaging the receiving mechanism from the engagement mechanism. The release button can be proximate or adjacent the engagement mechanism, the receiving mechanism, or both. A release button can be used to disengage the aperture from the post, or vice versa, to allow translation and/or removal of the insert.

Accordingly, a package can include an insert with an anterior region, a posterior region, and opposing wings and an enclosure adapted for housing the insert. The enclosure can include opposing interior channels extending within the enclosure. The channels can be configured to slideably receive the wings of the insert. The insert can be disposed within the enclosure with the wings disposed for motion within the channels.

According to an aspect of the disclosure, at least one lug extends from at least one wing.

According to another aspect of the disclosure, at least one lug extends from each wing.

According to another aspect of the disclosure, the lugs are shaped to facilitate movement of the wings within the opposing channels.

According to another aspect of the disclosure, each of the opposing channels can be formed by an outer channel wall with a first length, a first posterior terminal end, and a spaced apart inner channel wall with a second length less than the first length, and a second posterior terminal end offset from the first posterior terminal end so as to provide an opening into the channel for a the wing of the insert.

According to another aspect of the disclosure, the channels extend from an inner wall of the enclosure. Each of the wings is substantially aligned within the opening in the channels. Additionally, the insert is adapted for the wings to displace when a force is exerted to the posterior region of the insert.

According to another aspect of the disclosure, the package further includes a deflectable tab formed in a wall of the enclosure. The deflectable tab is disposed and adapted for receipt and transference of the force to the posterior region.

According to another aspect of the disclosure, the package further includes a selectively releasable locking mechanism for inhibiting the insert from being withdrawn from the enclosure.

According to another aspect of the disclosure, the selectively releasable locking mechanism is achieved by including at least one lock aperture in the posterior region of the insert, at least one locking pin extending from a wall of the enclosures corresponding to and adapted for engagement of the lock aperture, and, a biasing element for urging the insert to maintain the at least one locking pin inserted within the at least one lock aperture.

According to another aspect of the disclosure, the deflectable tab is configured to disengage the at least one locking pin from the at least one lock aperture, and to transversely displace the wings.

According to another embodiment of the disclosure, a package includes an insert with an anterior region, a posterior region, and at least one wing extending therefrom. The package also includes an enclosure for housing the insert. The enclosure includes at least one interior channel extending within the enclosure. The at least one interior channel can be configured to slideably receive the wing. The insert can be adapted to be disposed within the enclosure with the wing disposed for motion within the channel.

According to an aspect of the disclosure, the posterior region of the insert includes a second extending wing. The enclosure includes a second interior channel that can slideably receive the second extended wing of the insert.

According to another aspect of the disclosure, the at least one wing includes a lug extending therefrom.

According to another embodiment of the disclosure, a package insert includes a first planar surface for holding items, at least one lock aperture located within the planar surface, at least one edge adjacent to the surface, and at least one wing extending from the at least one edge. The surface can be configured to be at least partially housed within an enclosure, and the at least one wing can be configured to slideably engage at least one channel located within the enclosure.

According to an aspect of the disclosure, the package insert can include a second edge and a second wing extending therefrom.

According to another aspect of the disclosure, the second wing can be configured to slideably engage a second channel located within the enclosure.

According to another aspect of the disclosure, the at least one wing includes at least one releasable locking element configured to engage the enclosure.

According to another embodiment of the disclosure, a package enclosure includes a first housing member, a second housing member attached to the first housing member, and an interior space defined by the attached housing members. An insert can be at least partially received in the space. At least one locking pin can be located within the space. The at least one locking pin can be configured to engage the insert. At least one release element can be located on one of the housing members. The at least one release element can be configured to selectively disengage the insert. At least one channel can be located within the space. The at least one channel can be configured to slideably engage a wing extending from the insert.

According to an aspect of the disclosure, the package enclosure can include releasable locking elements configured to engage the insert wing to at least one of the members.

DETAILED DESCRIPTION

Figure 1:
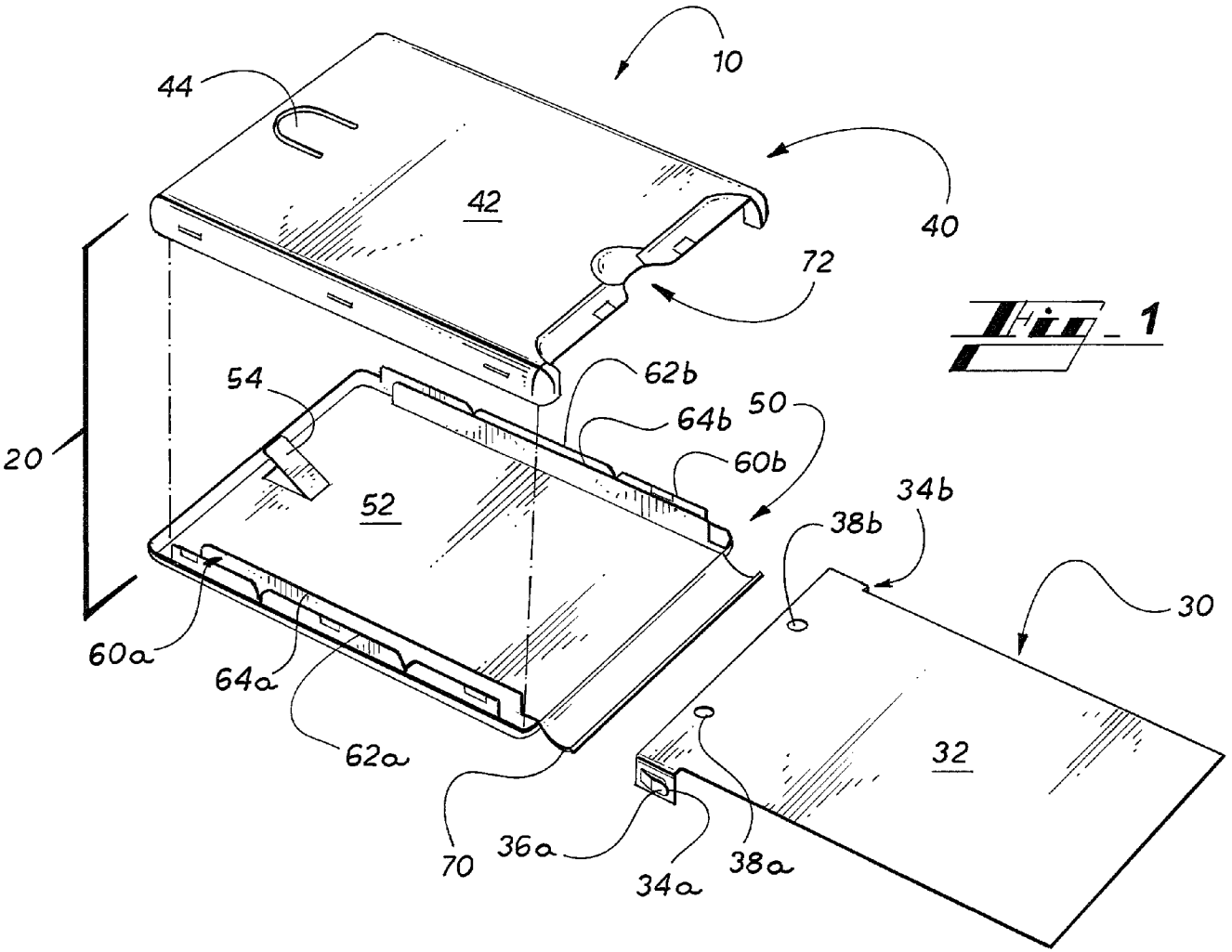
FIG. 1 is an exploded perspective view of an exemplary embodiment of an insert package, according to the present disclosure.

As required, detailed embodiments of the present disclosure are disclosed herein. It must be understood that the disclosed embodiments are merely exemplary of the disclosure that may be embodied in various and alternative forms, and combinations thereof. As used herein, the word "exemplary" is used expansively to refer to embodiments that serve as illustrations, specimens, models, or patterns. The figures are not necessarily to scale and some features may be exaggerated or minimized to show details of particular components. In other instances, well-known components, systems, materials, or methods have not been described in detail in order to avoid obscuring the present disclosure. Therefore, specific structural and functional details disclosed herein are not to be interpreted as limiting, but merely as a basis for the claims and as a representative basis for teaching one skilled in the art to variously employ the present disclosure.

Referring now to the drawings, wherein like numerals indicate like elements throughout the several views, the drawings illustrate certain of the various aspects of exemplary embodiments.

As an overview, the disclosure teaches an insert package having the primary elements of an insert that is housed within an enclosure. The insert may be inserted into a fully-formed enclosure, locked in a fully-inserted position, and then selectively unlocked for withdrawal. Upon the insert being unlocked, insert wings are fully positioned within a channel within which the wings are translatable. The insert and enclosure may be formed to inhibit full withdrawal of the insert.

Referring to FIG. 1, a perspective exploded view of an exemplary embodiment of an insert package 10 according to the present disclosure, shows the primary elements of the disclosure, namely, an insert 30 and an enclosure 20. The enclosure is formed of two primary elements, namely, an upper housing member 40 and a lower housing member 50. Although the disclosure contemplates enclosures 20 of many different geometric configurations, including but not limited to squares and non-rectilinear geometric shapes, the illustrated embodiments are directed to a structure that in general facilitates straight-line movement of the insert 30.

The upper housing member 40 has an elongated centrally disposed upper housing wall 42. A lock-release mechanism 44 in the form of a deflectable tab is integrally formed in a posterior region of the upper housing wall 42. Additional elements contained in the interior of the upper housing member 40 will be described with reference to FIG. 2.

The lower housing member 50 has an elongated central disposed lower housing wall 52. A biasing element 54 in the form of a leaf-type spring extends upwardly from the lower housing wall 52, at a posterior region thereof. Channels 60*a*, 60*b* are formed along the side edges of the lower central housing portion 50 by a substantially parallel pair of outer channel walls 62*a*, 62*b* and inner channel walls 64*a*, 64*b*. In each channel 60*a*, 60*b*, the outer channel walls 62*a*, 62*b* terminate in the posterior region of the lower housing wall 52. The inner channel walls 64*a*, 64*b* also terminate in the posterior region of the lower housing wall 52, but are offset from the terminating ends of the outer housing walls 62*a*, 62*b*. A hinged door 70 is affixed at an anterior end of the lower housing wall 52 to cover an opening 72 (best shown in FIG. 2) formed at the anterior end of the assembled enclosure 20.

The insert 30 has a substantially planar, elongated central insert piece 32. The posterior end of the central insert piece 32 includes opposing wings 34*a*, 34*b* extending from the central piece 32. Lugs or detents 36*a*, 36*b* ("lugs" respectively extend outwardly of each wing 34*a*, 34*b*. Here, each lug 36*a*, 36*b* is illustrated as having a wedge shape. At least one lock aperture 38*a*, 38*b* is formed at a posterior end of the central insert piece 32. A pair of opposing lock apertures 38*a*, 38*b* is used in the exemplary embodiment of the package 10.

Figure 2:
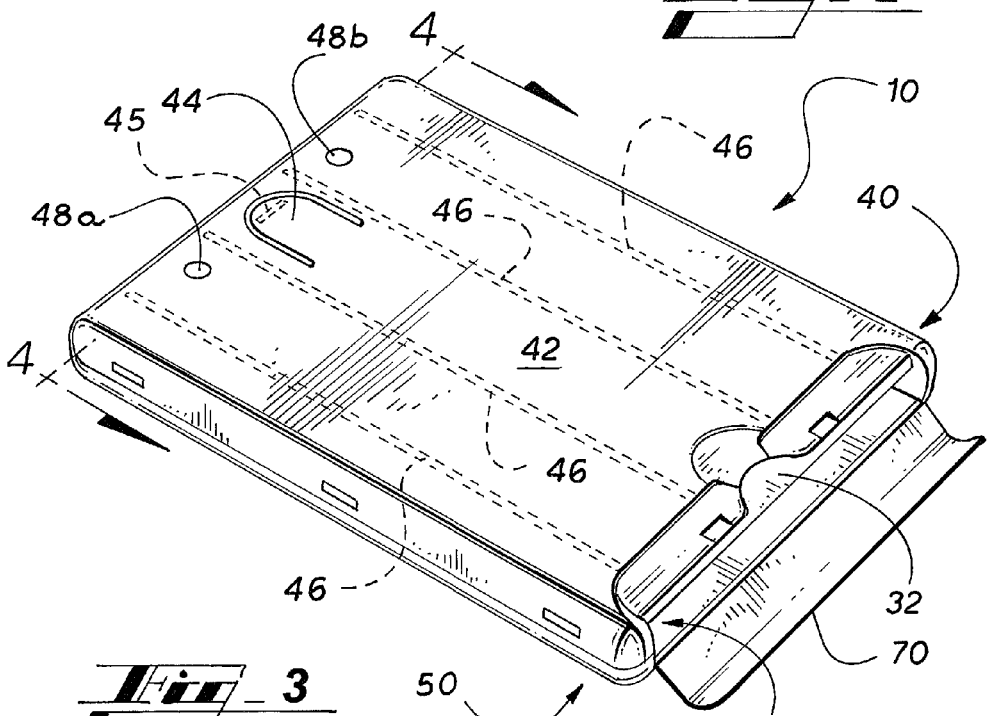
FIG. 2 is a perspective view showing the assembled exemplary insert package of FIG. 1, according to the present disclosure.

Referring to FIG. 2, an exemplary embodiment of the insert package 10 is shown, in a see-through illustration, showing ribs 46 extending inwardly of the upper housing wall 42. The lock-release mechanism 44 can have a protruding lip 45 for helping to engage and release the insert 30, as explained below. One or more lock members 48*a*, 48*b*, shown here as pins, extend inwardly from the upper housing wall 42 for engagement with the corresponding lock apertures 38*a*, 38*b* of the insert 30.

Figure 3:
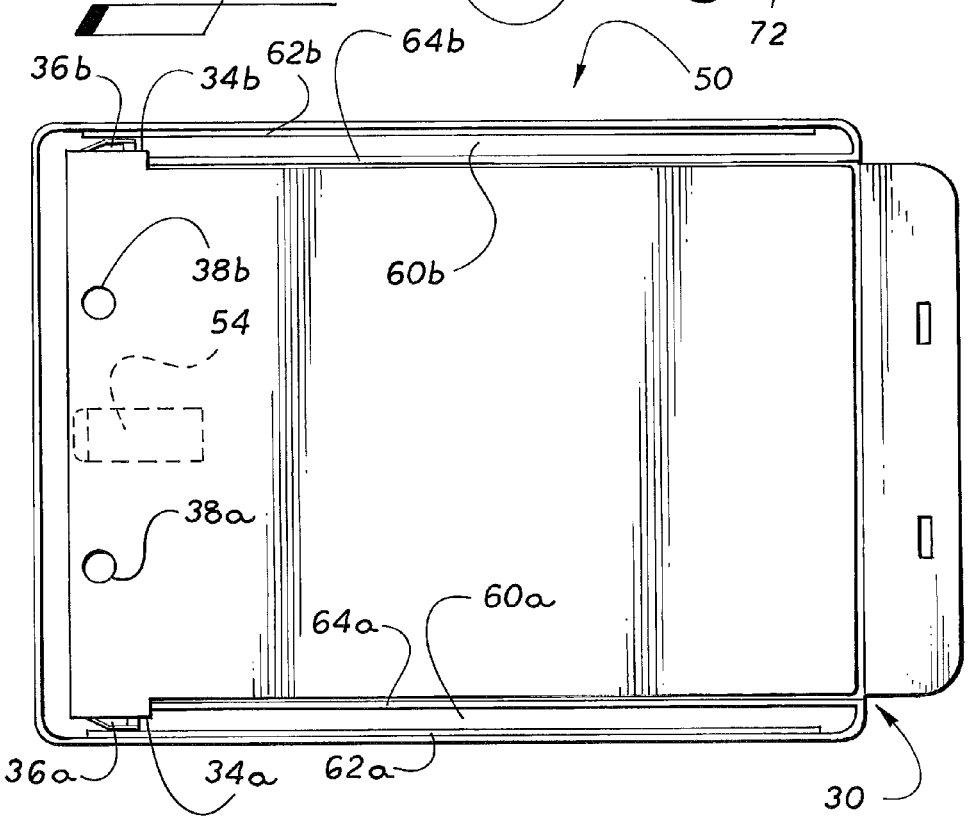
FIG. 3 is a top plan view of the lower housing member of an exemplary embodiment of an insert package, including the insert, according to the present disclosure.

FIG. 3 is a top plan view of an exemplary embodiment of the lower housing member 50 with the insert 30 fully inserted into the lower housing member 50. In this view the general alignment of the wings 34*a*, 34*b* and lugs 36*a*, 36*b* of the insert 30 with respect to the channels 60*a*, 60*b* is shown.

Figure 4:
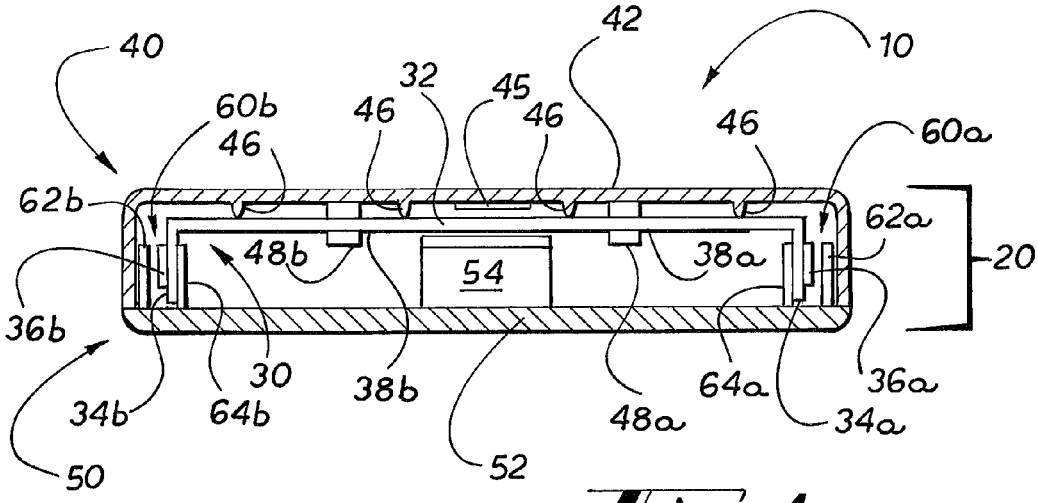
FIG. 4 is a sectional view of the exemplary insert package of FIG. 2 taken along line 4-4 of FIG. 2.

FIG. 4 is a section view of an exemplary embodiment of the insert package 10, taken along line 4-4 of FIG. 2 just inside the posterior end of the enclosure 20 looking toward the anterior end. The alignment of various elements can be seen in this view. The insert 30 is sandwiched between the upper housing member 40 and lower housing member 50 that have been joined to form the enclosure 20. The wings 34*a*, 34*b* and lugs 36*a*, 36*b* of the insert are substantially aligned for passage along the respective channels 60*a*, 60*b* respectively formed by the outer channel walls 62*a*, 62*b* and the inner channel walls 64*a*, 64*b*.

Locking members 48*a*, 48*b*, for example, posts, pins, lips, springs, or the like ("locking pins"), extend through the lock apertures 38*a*, 38*b* of the fully inserted insert 30. The biasing element (spring) 54 biases, or urges, the insert 30 upwardly against the ribs 46 of the upper housing member 40 thereby maintaining the insert 30 captured between the locking pins 48*a*, 48*b* and biasing element 54 until selectively removed therefrom.

Figure 5:
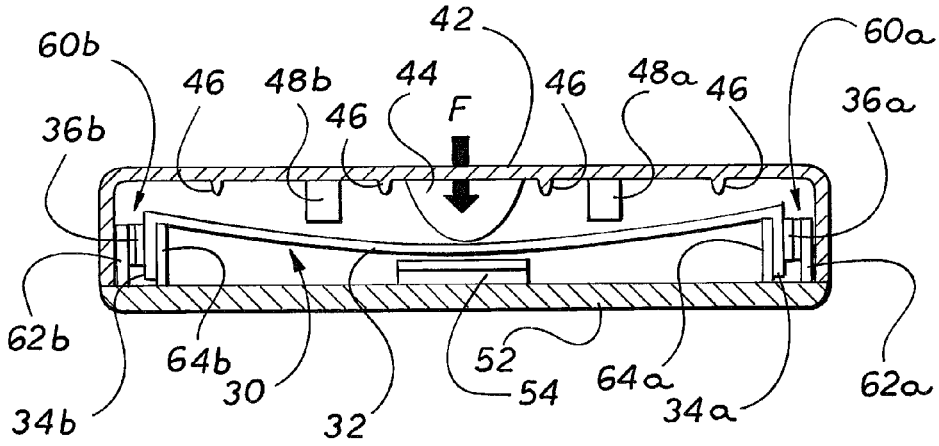
FIG. 5 is similar to FIG. 4, showing a force applied to unlock the insert of the exemplary package, according to the present disclosure.

Referring now to FIG. 5, there is shown the operation of the lock-release mechanism 44 when a force F is applied to counter the biasing member 54 and urge the central insert piece 32 inwardly, wherein the central insert piece 32 deforms at least slightly, bowing, or deflecting, inwardly away from the locking members 48*a*, 48*b*. This bowing/deflecting action also causes the wings 34*a*, 34*b* to splay or extend at least slightly transversely outwardly into a position fully aligned in the channels 60*a*, 60*b*. Full application of the force F frees the insert 30 from the locking pins 48*a*, 48*b*, thereby unlocking the insert 30 while, at the same time, aligning the wings 34*a*, 34*b* and lugs 36*a*, 36*b* for movement within the channels 60*a*, 60*b*.

Referring now to FIGS. 3-6, an exemplary embodiment of a mode of constructing a package 10 will be described. The enclosure 20 is formed by assembling the upper housing member 40 and lower housing member 50. Although the insert 30 may be placed within the enclosure 20 during assembly thereof, the disclosure also teaches that the insert 30 may be inserted into the enclosure 20 through the anterior opening 72. Although the lugs 36*a*, 36*b* may have alternative configurations, the wedge shape provides an inclined surface that together with the flexibility of the substantially planar insert 30 enables the insert 30 to slide along the inner surface of the inner channel walls 64*a*, 64*b* until seated at the posterior end of the enclosure 20.

As shown in FIGS. 3 and 4, the insert wings 34*a*, 34*b* generally fit within the space defined by the offset between the posterior termination points of the outer channel walls 62*a*, 62*b* and the inner channel walls 64*a*, 64*b*. In addition, as shown in FIG. 4, the wings 34*a*, 34*b* may at least slightly overlap the end of the inner channel walls 64*a*, 64*b* to provide an additional locking effect for retaining the insert 30 within the enclosure 20 until released, as described above. The illustrated locking pins 48*a*, 48*b* include a beveled anterior portion that facilitates passage of the posterior end of the insert 30 over the pins 48*a*, 48*b* for easier engagement of the lock apertures 38*a*, 38*b*. It should be understood, however, that the locking pins 48*a*, 48*b* can have alternative configurations.

Figure 6:
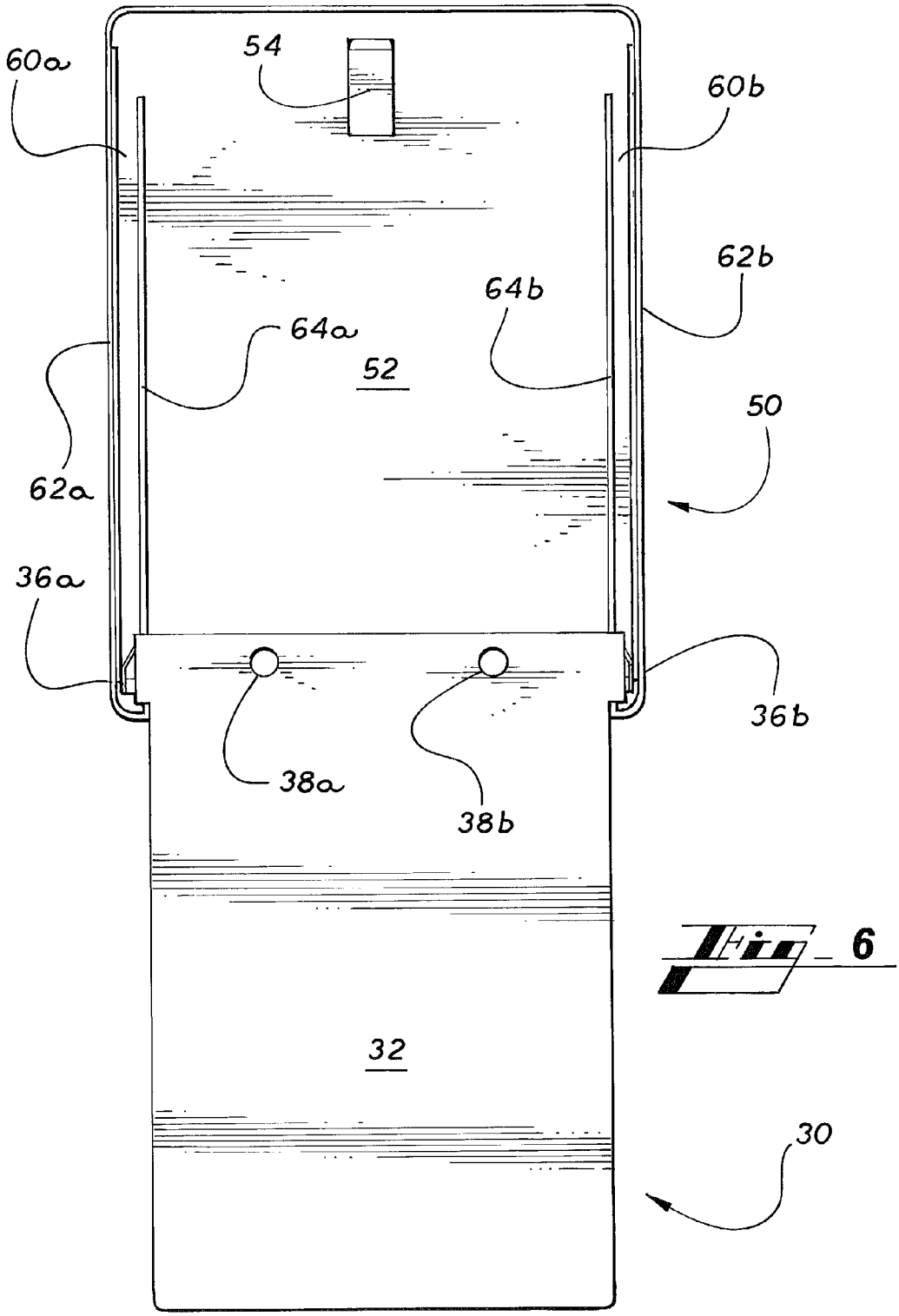
FIG. 6 is a top plan view of the lower housing member of an exemplary embodiment of an insert package, showing the insert withdrawn to the anterior end of the enclosure, according to the present disclosure.

Although the package 10 may be constructed to allow full withdrawal of the insert 30, the exemplary embodiments illustrate the design option of each channel 60*a*, 60*b* terminating at an anterior wall portion of the lower housing member 50 that obstructs travel of the wings 34*a*, 34*b* beyond the anterior end of the enclosure 20. FIG. 6 illustrates the insert 30 fully extended, as is possible with this design option. Although not illustrated in the figures, a user can form a fully enclosed, locked package 10 by closing the door 70.

Another contemplated embodiment of a lockable package includes an enclosure 20 and an insert 30, substantially similar to the embodiments described above, however, the insert 30 and the enclosure 20 can be made without respective locking mechanisms 38*a*, 38*b*, and 48*a*, 48*b*, and without the release 44. Instead, the door 70 can be used to hold the insert 30 in the enclosure 20. Additional locking features can be included on the door 70, if desired. Other features, such as the wings 34*a*, 34*b* and the channels 60*a*, 60*b*, are included substantially as illustrated above, such that this alternative package otherwise functions in much the same way as the package 10 described above.

The package 10 can be made of a variety of materials having the requisite characteristics to provide points of flexibility described herein. Although materials such as lightweight metals and substantially rigid but flexible paperboard may be used, the disclosure may be suitably practiced using a plastic material. In addition, the enclosure 20 and insert 30 may be made of different materials or even different thicknesses or weights of the same material without departing from the scope and teachings hereof.

The disclosure has been illustrated and described in the context of a so-called blister package that is typically used to store and dispense individual (or unit) doses of a medication on a blister card housed in an enclosure 20. However, the disclosure is more broadly applicable to a substantially planar insert 30 that can hold and store all types of portable items, whether held with blisters, attached to a tray, or otherwise secured to a surface that can be received by an enclosure 20. An advantage of the present disclosure is that it permits full and efficient use of the planar insert 30, which can translate in and out of the enclosure 20 without interference from internal features other than the intended lock pins 48*a*, 48*b*.

The exemplary embodiments of the disclosure are illustrated in an orientation that designates an upper housing member 40 and a lower housing member 50. However, the package 10 may be inverted, or turned upside down, thereby reversing the orientation and designations without departing from the teachings of the disclosure.

In some embodiments, during assembly the insert card 30 is placed so that the wings 34*a*, 34*b* or lugs 36*a*, 36*b* are inserted directly into the rails or channels 64*a*, 64*b*. The housing members 40, 50 are then assembled to form the enclosure 10. In other embodiments the wings 34*a*, 34*b* or lugs 36*a*, 36*b* are directed into the rails or channels 60*a*, 60*b* when the release 44 is activated, as described above.

Referring again to FIG. 4, it can be appreciated that if the enclosure 20 is substantially completely assembled prior to placing the insert 30 in position, the insert 30 may not fit through the illustrated opening 72. It may be particularly difficult to fit the insert 30 through the opening 72 if the distance across the outer edges of the wings 34*a*, 34*b* exceeds the dimension of across the opening 72, as is illustrated in FIG. 4. Therefore, the flexibility of the insert 30 can help allow insertion of the insert 30 into the package 10 after the enclosure 20 has been assembled. The insert 30 can be flexed by compressing the wings 34*a*, 34*b* toward the center of the insert 30, substantially as illustrated in FIG. 5. By compressing the wings 34*a*, 34*b*, the distance across the outer edges of the wings 34*a*, 34*b* can be reduced, and the insert 30 can then be easier to insert into the enclosure 30. The insert 30 can travel into the enclosure 20 with the wings 34*a*, 34*b*, or more particularly, the lugs 36*a*, 36*b*, if included, sliding across the face of the inner channel walls 64*a*, 64*b*. Once the insert 30 is substantially completely inserted, the wings 34*a*, 34*b* can spring out of the compressed configuration described above, thereby returning to a position at which the wings 34*a*, 34*b* can travel through the channels 60*a*, 60*b*, substantially as illustrated in FIG. 3. The package 10 can then be used as described above.

Although the following feature is not illustrated, it is contemplated that in some embodiments, the wings 34*a*, 34*b* or lugs 36*a*, 36*b* can releasably engage locking elements such as apertures positioned along the edges of the enclosure 20. In other words, it is contemplated that the wings 34*a*, 34*b* or lugs 36*a*, 36*b* include engaging elements that releaseably engage the side walls of the enclosure 20 or one of the housing members 40, 50. Alternatively, the engaging elements can releaseably engage the rails or channels 60*a*, 60*b*. The advantage of the additional locking elements is to provide for indexing or incremental extending of the insert 30. Such locking elements further increase the child-resistant features of the package 10.

In some embodiments the rails or channels 60*a*, 60*b* are formed by walls integral to the housing members 40, 50. In other embodiments additional walls or rails proximate the integral side walls form the rails 60*a*, 60*b*.

The law does not require and it is economically prohibitive to illustrate and teach every possible embodiment of the present claims. Hence, the above-described embodiments are merely exemplary illustrations of implementations set forth for a clear understanding of the principles of the disclosure. Variations, modifications, and combinations may be made to the above-described embodiments without departing from the scope of the claims. All such variations, modifications, and combinations are included herein by the scope of this disclosure and the following claims.

What is claimed is:

1. A lockable package comprising:

an insert and an enclosure for housing the insert, wherein:

the insert comprises at least one wing; and, the enclosure comprises at least one receiving channel configured to receive the wing of the insert, wherein the enclosure comprises a plurality of receiving channels, wherein the insert comprises a plurality of wings and at least one lug proximate each wing, wherein the channels are formed by an outer channel wall with a first length and a first posterior terminal end, and a spaced apart inner channel wall with a second length less than the first length, and a second posterior terminal end offset from the first posterior terminal end to provide an opening into the channel for a wing of the insert, wherein the channels extend from an inner wall of the enclosure, and each wing is substantially aligned within the opening in the channels, and wherein the insert is adapted to allow the wings to displace when an external force is exerted on the insert, the package further comprising a deflectable tab associated with the enclosure configured to transfer the external force to the insert, the package further comprising a selectively releasable locking mechanism configured to inhibit the insert from being withdrawn from the enclosure, wherein the selectively releasable locking mechanism comprises:

the insert comprising a first engagement mechanism;

the enclosure comprising a second engagement mechanism configured to engage the first engagement mechanism; and, a biasing element operatively connected to the enclosure to apply a biasing force to the insert to maintain the first engagement mechanism engaged with the second engagement mechanism, and, wherein the deflectable tab is configured to disengage the first engagement mechanism from the second engagement mechanism, and to transversely displace the wings.

2. The package of claim 1, wherein the first engagement mechanism comprises a locking aperture.

3. The package of claim 2, wherein the second engagement mechanism comprises a locking pin.

4. The package of claim 1, wherein each of the wings comprises at least one lug.

5. A lockable package comprising an enclosure and an insert received in the enclosure to translate along a first axis between a fully inserted position and a dispensing position, the insert when in the fully inserted position being closest at a rear end thereof to a posterior end wall of the enclosure, the insert when in the dispensing position being closest at the rear end thereof to an anterior end of the enclosure, wherein the enclosure comprises at least one channel defined at least in part by an inner channel wall extending along the first axis, the at least one channel having a channel opening between the posterior end wall of the enclosure and a posterior terminal end of the inner channel wall, wherein the insert comprises at least one wing disposed in locking engagement with the posterior terminal end of the inner channel wall when the insert is in the fully inserted position, and the at least one wing is disposed and dimensioned such that the at least one wing is movable transversely of the first axis into the at least one channel through said channel opening to be out of said locking engagement and to be translatable along the at least one channel.

6. The package of claim 5, wherein the length of the at least one wing along the first axis is substantially less than the length of the inner channel wall along the first axis.

7. The package of claim 5, wherein the at least one channel has a closed end for locking engagement with the at least one wing to inhibit full withdrawal of the insert from the enclosure, the closed end being disposed adjacent an anterior terminal end of the inner channel wall.

8. The package of claim 5, wherein the enclosure further comprises upper and lower housing members secured together to define an interior space between the upper and lower housing members, wherein the insert is at least partially received in the interior space.

9. The package of claim 8, wherein the enclosure further comprises a first engagement mechanism located substantially within the interior space, the first engagement mechanism configured to engage a second engagement mechanism at the insert, and the enclosure further comprises a release element located at one of the housing members, the release element configured to selectively disengage the first engagement mechanism from the second engagement mechanism.

10. A lockable package comprising an enclosure and an insert, wherein the enclosure comprises first and second opposed side walls, a posterior end wall, and first and second spaced inner channel walls, the first and second inner channel walls being disposed substantially parallel to the first and second side walls respectively such that a first channel is defined between the first side wall and the first inner channel wall and such that a second channel is defined between the second side wall and the second inner channel wall, the insert being received in the enclosure to translate along the first and second channels to and from a fully inserted position at which the insert is disposed closest to the posterior end wall of the enclosure, each of said first and second channels having a channel opening adjacent a posterior terminal end of a respective said inner channel wall, wherein the insert comprises first and second opposed wings disposed in locking engagement with the posterior terminal ends of the first and second inner channel walls respectively when the insert is in the fully inserted position, and the first and second wing are disposed and dimensioned such that the first and second wings are movable away from each other into the first and second channels through said channel openings to be out of said locking engagement.

11. The package of claim 10, wherein the enclosure further comprises an anterior open end opposite said posterior end wall so that the insert can be inserted into the enclosure through the anterior open end.

12. The package of claim 11, wherein the enclosure further comprises a cover for closing the open end.

13. The package of claim 11, wherein the enclosure further comprises first and second outer channel walls, the first outer channel wall being disposed between the first inner channel wall and the first side wall, the second outer channel wall being disposed between the second inner channel wall and the second side wall.

14. The package of claim 11, wherein said each said channel has a closed end for locking engagement with a respective one of the first and second wings to inhibit full withdrawal of the insert from the enclosure, and the anterior open end of the enclosure extends between the closed ends of the first and second channels.

15. The package of claim 10, wherein the first and second wings are disposed movable toward the first and second side walls respectively when the insert is in the fully inserted position.

16. The package of claim 13, wherein each of the first and second outer channel walls has a first length and a posterior terminal end, and each of the first and second inner channel walls has a second length less than the first length, the posterior terminal end of said each said outer channel wall is offset from the posterior terminal end of said each said inner channel wall to provide said channel opening.

17. The package of claim 11, wherein the inner channel walls extend from the anterior open end of the enclosure toward the posterior end wall of the enclosure, the first and second wings are substantially disposed within the channel openings of the first and second channels respectively when the insert is in the fully inserted position, and the insert is formed to allow the first and second wings to displace away from each other when an external force is exerted on the insert.

18. The package of claim 17, the enclosure further comprises a deflectable tab configured to transfer the external force to the insert.

19. The package of claim 18, further comprising a selectively releasable locking mechanism configured to inhibit the insert from being withdrawn from the enclosure.

20. The package of claim 19, wherein the selectively releasable locking mechanism comprises:

the insert comprising a first engagement mechanism;

the enclosure comprising a second engagement mechanism configured to engage the first engagement mechanism; and a biasing element operatively connected to the enclosure to apply a biasing force to the insert to maintain the first engagement mechanism engaged with the second engagement mechanism.

21. The package of claim 20, wherein the deflectable tab is configured to disengage the first engagement mechanism from the second engagement mechanism, and to displace the first and second wings away from each other.

* * * * *